US012690657B2

(12) United States Patent
Alexander et al.

(10) Patent No.: US 12,690,657 B2
(45) Date of Patent: Jul. 28, 2026

(54) NAIL UV/LED PRODUCTS CURING LAMP

(71) Applicant: Hayley Alexander, Santa Clarita, CA (US)

(72) Inventors: Hayley Alexander, Santa Clarita, CA (US); Hayden Ocean Rooney-Fletcher, Eugene, OR (US)

(73) Assignee: Hayley Alexander, Santa Clarita, CA (US)

( * ) Notice: Subject to any disclaimer, the term of this patent is extended or adjusted under 35 U.S.C. 154(b) by 596 days.

(21) Appl. No.: 18/159,613

(22) Filed: Jan. 25, 2023

(65) Prior Publication Data

US 2023/0232957 A1 Jul. 27, 2023

Related U.S. Application Data

(60) Provisional application No. 63/303,306, filed on Jan. 26, 2022.

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC ... A45D 29/00; A45D 29/22; A45D 2202/205
See application file for complete search history.

(56) References Cited

U.S. PATENT DOCUMENTS

| | | | | |
|---|---|---|---|---|
| 4,988,883 | A * | 1/1991 | Oppawsky | A45D 29/18 250/455.11 |
| 11,058,202 | B1 * | 7/2021 | Luu | F21V 33/0004 |
| 2020/0022476 | A1 * | 1/2020 | Gregory | F21V 1/00 |
| 2021/0120935 | A1 * | 4/2021 | Shashou | A45D 29/20 |
| 2023/0024415 | A1 * | 1/2023 | Haile | A45D 29/18 |

FOREIGN PATENT DOCUMENTS

CN 215766104 U * 2/2022

* cited by examiner

*Primary Examiner* — David E Smith
(74) *Attorney, Agent, or Firm* — Dergosits & Noah LLP

(57) ABSTRACT

A nail curing bowl comprising a hollow body. The hollow body includes a light-housing component removably attached to a base to create a UV irradiation area. The light-housing component includes a plurality of UV LED lights that generate UV radiation within the UV irradiation area. The hollow body further includes a hand rest that protrudes through an open top portion of the hollow body, allowing a user to rest the palm of their hand on the hand rest while extending their fingers downwards along the shaft of the hand rest into the UV irradiation area of the hollow body. The irradiation area is suitable for curing UV/LED curing product, while minimizing the user's exposure to the UV radiation emitted from the UV LED lights.

15 Claims, 13 Drawing Sheets

NAIL UV/LED PRODUCTS CURING LAMP

RELATED APPLICATION INFORMATION

This application is a non-provisional conversion of, and claims priority to Application Ser. No. 63/303,306, entitled "Nail Curing Lamp," filed Jan. 26, 2022.

FIELD OF THE INVENTION

The present invention relates generally to a UV/LED products nail curing lamp and, more particularly, to a nail curing lamp in a bowl shape comprising a light-housing component having an ergonomic hand rest.

BACKGROUND OF THE INVENTION

In recent years, gel manicures have been steadily gaining popularity because they are more durable than regular polishes. While regular nail polishes can chip as quickly as one to two days, gel nail polishes can stay chip-free for at least two weeks.

The durability of the gel nail polish is a result of curing the gel nail polish under a UV light, which creates a hardened layer of polish. In particular, gel polishes generally include photo initiators. A photo initiator is a chemical that reacts with UV light, usually from a nail curing lamp. When exposed to the wavelengths of UV light, the photo initiators give off free radicals. The release of the free radicals produces another reaction within the resins of the gel called polymerization. Polymerization causes the gel polish to harden and become into a solid durable plastic layer of polish.

The nail curing lamps that are currently used in salons and sold online to cure gel nail polishes not only expose a user's finger nails to UV light but also expose the user's hands. The exposure of the user's hand to the UV light can cause damage to skin because of the emitted radiation from the UV light. For example, exposing skin to UV radiation can cause premature wrinkles, age spots, and even skin cancer.

In current approaches, to limit the exposure of skin to UV radiations, users of nail curing lamps may use UV protecting sunscreen, fingerless gloves containing titanium dioxide, or an LED light lamp instead of a UV light lamp. These current approaches are often inconvenient and inefficient. For example, using sunscreen on hands during a manicure can create issues with the gel nail polish adhering to the nail, using fingerless gloves during a manicure can be uncomfortable, and using an ordinary LED light lamp inhibits the polymerization process which results in a less durable plastic layer of polish.

It should, therefore, be appreciated that there exists a need for a nail curing lamp using UV LED technology in the shape of a manicure bowl housing UV LED lights with an integrated hand support, that provides exposure of the UV/LED nail curing products to the UV light but limits the exposure of skin on the rest of the hands.

SUMMARY OF THE INVENTION

The various embodiments of the present nail curing bowl that provides a multiple-angle-accessible curing apparatus for UV/LED curing products. The nail curing bowl has several features, no single one of which is solely responsible for its desirable attributes. Without limiting the scope of the present embodiments as expressed by the claims that follow, the more prominent features now will be discussed briefly.

After considering this discussion, and particularly after reading the section entitled "Detailed Description," one will understand how the features of the present embodiments solve the problems discussed in the Background and provide the advantages described herein.

A nail curing bowl is provided and includes a base plate removably attached to a light-housing component. The light-housing component comprises a rim and a hand rest protruding from one side of the inner surface of the light-housing component. The hand rest protrudes above the top rim of the light-housing component. The position and shape of the hand rest allows a user to grip the top of the hand rest so the fingers of the user extend down the shaft of the hand rest. The position of the fingers along the shaft portion of the hand rest allows only the nails of the fingers to be exposed to the field of light within the interior of the light-housing component.

DETAILED DESCRIPTION OF THE PREFERRED EMBODIMENTS

In the following detailed description, reference is made to the accompanying drawings, which form a part hereof, and in which is shown by way of illustration specific exemplary embodiments of the invention. These embodiments are described in sufficient detail to enable those of ordinary skill in the art to make and use the invention, and it is to be understood that other changes may be made to the specific embodiments disclosed without departing from the spirit and scope of the present invention.

Figure 1:
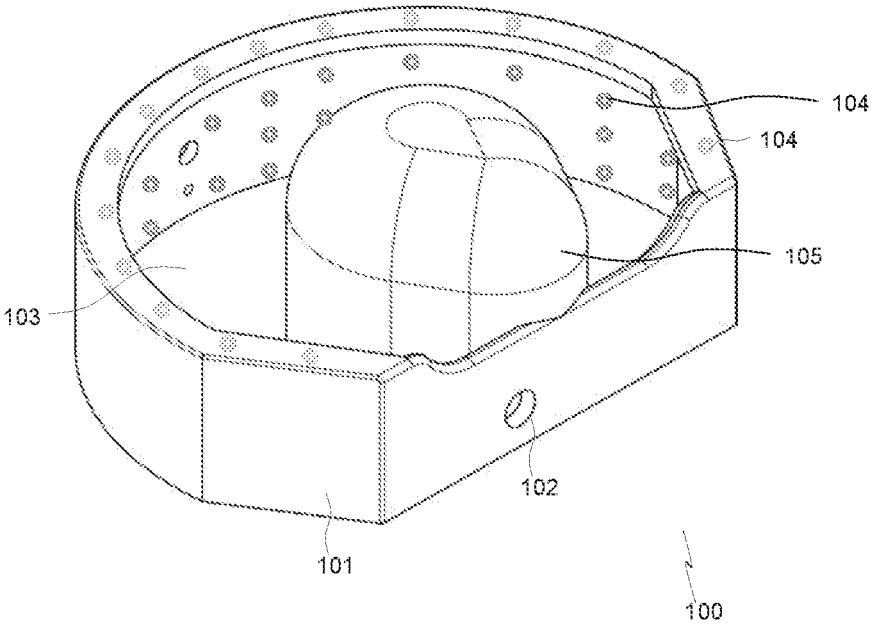
FIG. 1 illustrates a top perspective view of the nail curing bowl.
Figure 2:
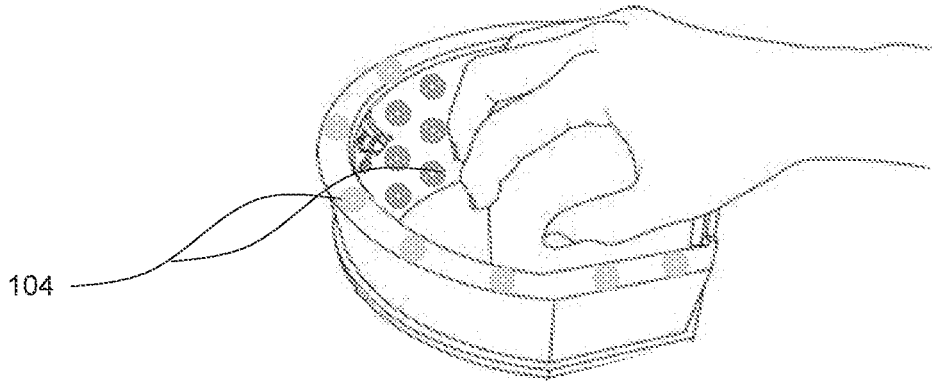
FIG. 2 illustrates a hand of a user using the nail curing bowl.

FIG. 1 illustrates a nail curing bowl 100 according to an embodiment of the present invention which includes a light-housing component 101, a power module socket 102, a removable base plate 103, a hand rest 105, and lighting elements 104. To cure nail polish, acrylic, and the like, UV/LED curing products, using the nail curing bowl 100, the user rests the palm of their hand on the top portion of the hand rest 105 and grips the sides of the hand rest 105 with their fingers, as illustrated in FIG. 2. The top of the hand rest 105 protrudes up from the removable base plate 103 past the height of the light-housing component 101. This configuration protects the top of the hand and fingers of the user from the rays of light emitted from the lighting elements 104, because the rays of light emitted from the lighting elements 104 only come into direct contact with the user's finger nails that extend downward into the light-housing component 101.

Figure 3:
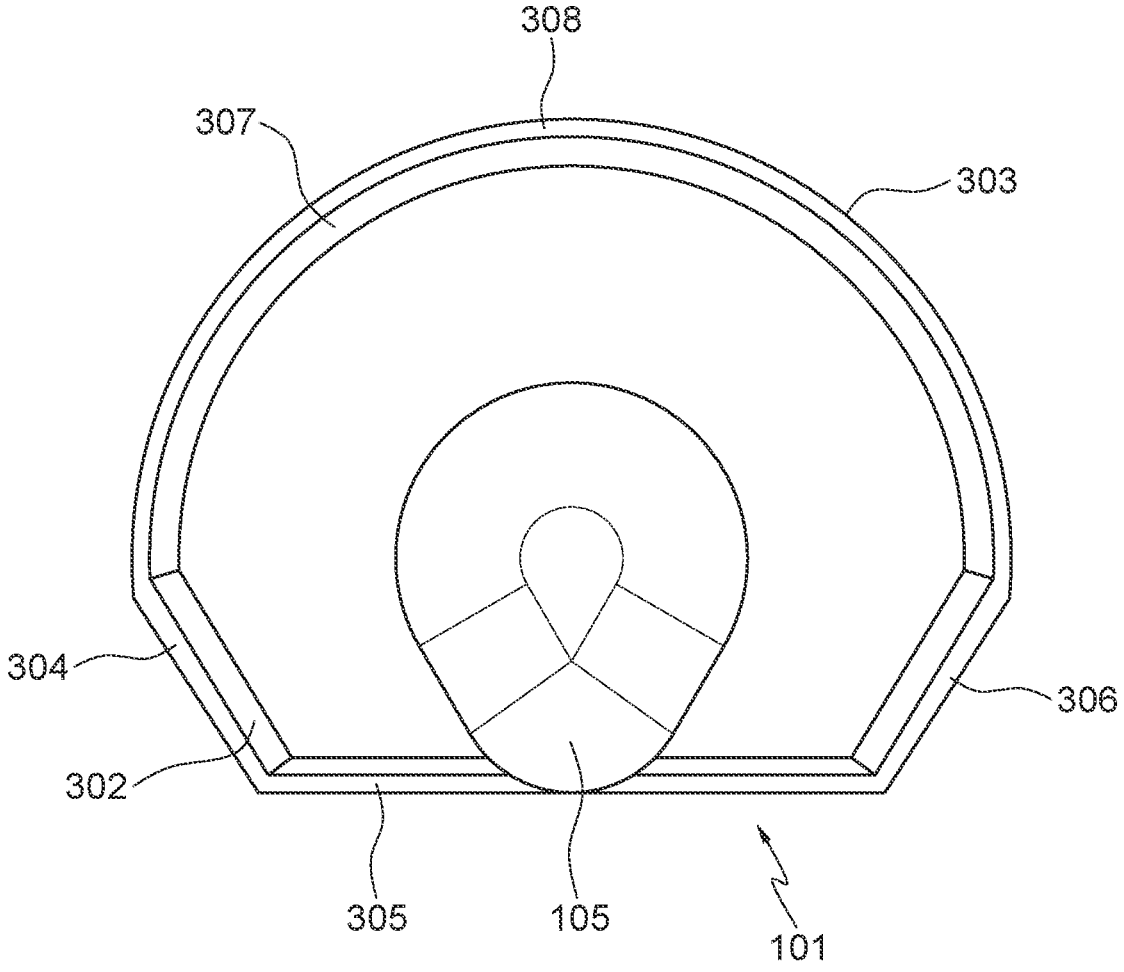
FIG. 3 illustrates a partially transparent front side perspective view of the light-housing component of the nail curing bowl.

FIG. 3 illustrates a partially transparent front side perspective view of the light-housing component 101. The light-housing component 101 comprises a hand rest 105 protruding inward into the light-housing component 101 from an inner surface 302, an outer surface 303, a first straight side 304, a second straight side 305, a third straight side 306, and a fourth rounded side 307. While the light-housing component 101 is depicted as having four sides, any suitable shape may be utilized, such as a circular shape having no straight sides.

The light-housing component 101 comprises light mounted to the inner surface 302 of at least one side of the light-housing component 101. The light mounted to the inner surface 302 of the light-housing component 101 may be any type of light preferred by the manufacturer to cure gel nail polishes, acrylic nails, or UV/LED curing products. In a preferred embodiment, inner surface 302 of the light-housing component 101 comprises a plurality of UV LED lights that emit UVA rays to cure gel nail polishes, acrylic nails, or UV/LED curing products. The UV LED lights are mounted to the wall of at least one of the first straight side 304, a second straight side 305, a third straight side 306, and a fourth rounded side 307 as to generate an evenly distributed field of light in the interior of the nail curing bowl. The UV LED lights may be mounted throughout the inner surface 302 or may be mounted only on part of the inner surface 302. For example, the UV LED lights may be mounted to the inner surface 302 only near the top end of the light-housing component 101, only near the bottom end of the light-housing component 101, a combination of near the top end and the bottom end of the light-housing component 101, or throughout inner surface 302 of the light-housing component 101. FIG. 1 and FIG. 2 illustrate a plurality of UV LED lights mounted to the inner surface of the top end and mounted throughout the inner surface 302 of the light-housing component 101. The number and type of lights will be dependent upon the size and circumference of the walls of the light-housing component 101 and other factors, such as desired brightness of the distributed field of light within the interior of the nail curing bowl. Although shown as a plurality of lights mounted to the walls of the light-housing component, one skilled in the art appreciates that any number of lights and any type of lighting may be mounted to the inner surface of the light housing component, such as a single tubular UV light.

In one embodiment, the inner surface 302 or part of the inner surface 302 of the light-housing component 101 may comprise a reflective mirror to provide maximum exposure of field of light within the nail curing bowl. The reflective mirror may be any type of mirror that reflects UV rays, such as an aluminum or a "first surface" mirror. The light field, including the UV rays, produced by the lights mounted to the inner surface of the light-housing component would bounce off the reflective mirror to increase the exposure of the nails of the user to the UV rays.

The top end of the light-housing component 101 comprises a rim 308. In one embodiment, the rim 308 may be an inwardly extending rim that protrudes into the body of the light-housing component, as illustrated in FIG. 1. The inwardly extended rim may reduce the distribution of the field of light outside of the nail curing bowl to protect the eyes and skin of a user using the nail curing bowl and/or the manicurist. The width and shape of the inward extension of the rim may be increased or decreased based on the number of lights, the brightness of the field of light, or other factors to prevent eye exposure and skin exposure to field of light.

Figure 5:
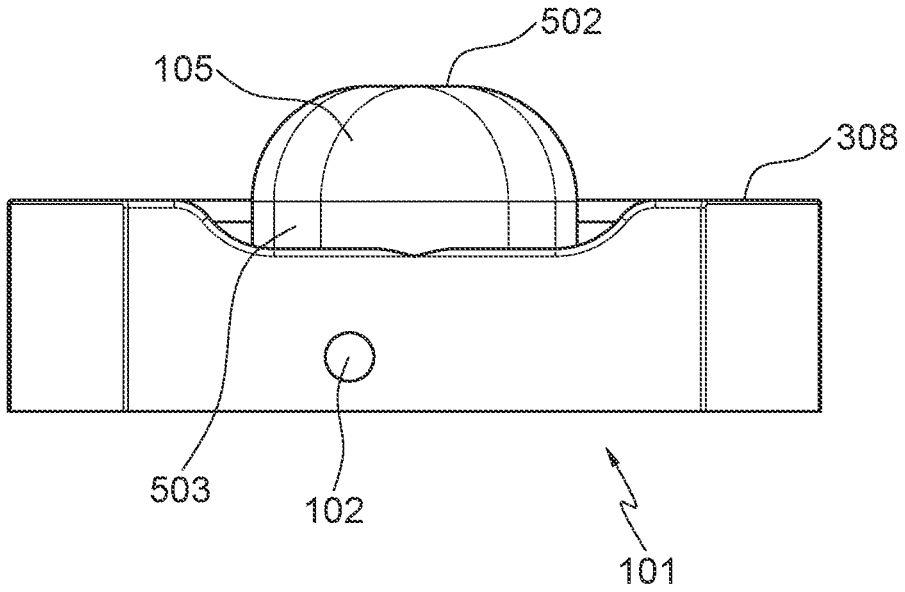
FIG. 5 illustrates a side plan view of the light-housing component of the nail curing bowl.

Returning to FIG. 3, the light-housing component 101 includes a hand rest 105. The hand rest 105 is disposed from the inner surface 302 of the second straight side 305 of the light-housing component 101 and extends proximate and over the top of the rim 308 of the top end, as illustrated in FIG. 5. In one embodiment, the hand rest 105 and the light-housing component 101 are one continuous piece. Alternatively, the hand rest 105 may be removably attached to the inner surface 302 of the light-housing component 101, or the hand rest 105 may be attached to the base plate of the nail curing bowl 100 and not to the inner surface 302 of the light-housing component 101.

Figure 4A:
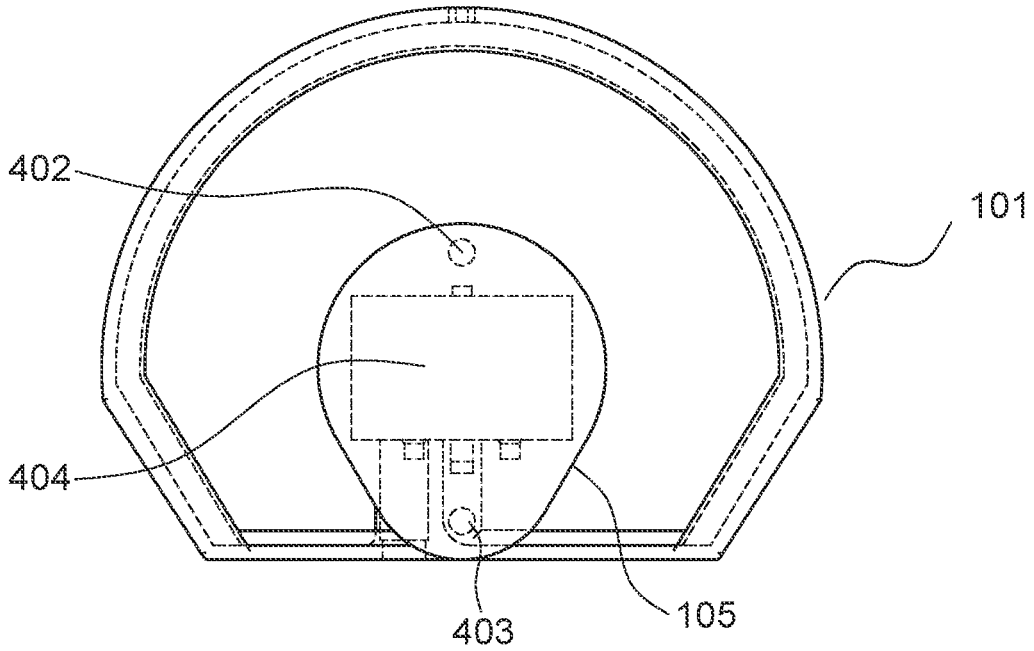
FIG. 4A illustrates a partially-transparent bottom plan view of the light-housing component of the nail curing bowl.
Figure 4B:
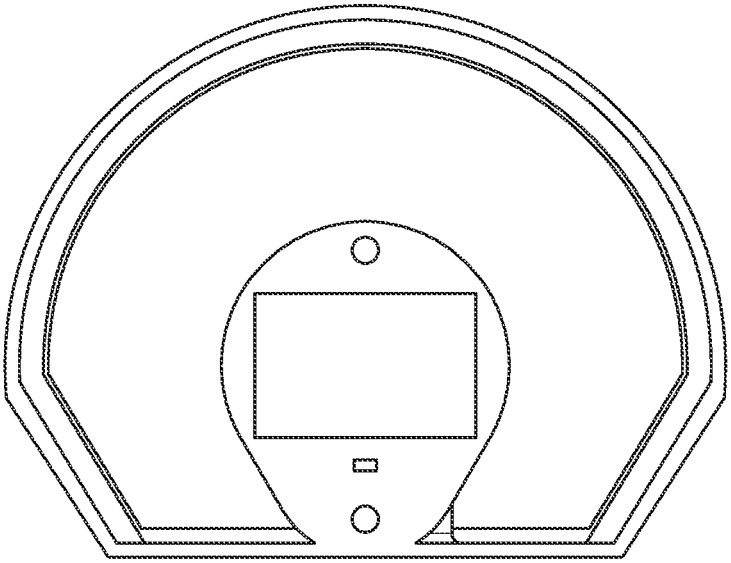
FIG. 4B illustrates a bottom plan view of the light housing component of the nail curing bowl.

FIGS. 4A and 4B illustrate bottom-up plan views of the light-housing component 101. The bottom of the hand rest 105 comprises a housing for a control unit 404, which controls the supply of electrical current to the UV lights, and two magnets 402 and 403. The two magnets are used to secure the light-housing component 101 to the removable base plate, which also comprises two magnets, illustrated in FIG. 11. Alternatively, the two magnets are used to secure the light-housing component 101 to an extension to the light-housing component 101, illustrated in FIG. 10. It can be appreciated that the number and position of the magnets can vary. In another embodiment, the base plate may be secured to the light-housing component without the use of magnets, using standard methods known in the art. For example, the base plate may include a mounting portion that secures the base plate to the bottom end of the light-housing component. FIG. 1 illustrates a view of the light-housing component 101 removably attached to the base plate 103 creating the nail curing bowl 100.

FIG. 5 illustrates a side view of light-housing component 101 having a hand rest 105 extending proximately and over the top of the rim 308. The hand rest 105 comprises a knob portion 502 and a shaft portion 503. Although not depicted in FIG. 5, in one embodiment, the diameter of the knob portion 502 is greater than the diameter of the shaft portion 503. The knob portion 502 of the hand rest 105 is contoured to provide ergonomic support for the palm of a hand and allows fingers to extend downwardly along the shaft portion 503 of the hand rest. The position and shape of the hand rest may vary to provide appropriate ergonomic support. For example, in another embodiment as depicted in FIG. 3 and FIG. 5, the position and "pear" shape of the hand rest 105 allows a user to grip the knob portion 502 of the hand rest 105 so the fingers of the user would be bent instead of straight along the shaft portion 503 of the hand rest 105, as illustrated in FIG. 2. The position of the bent fingers along the shaft portion of the hand rest allows only the nails of the fingers to be exposed to the field of light within the interior of the light-housing component. In this embodiment, the diameter of the knob portion 502 is less than the diameter of the shaft portion 503.

Figure 6A:
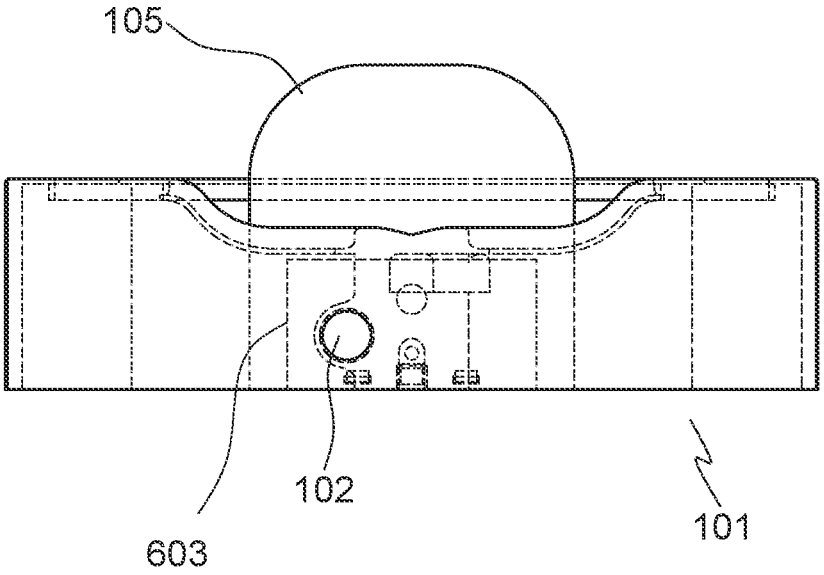
FIG. 6A illustrates a partially-transparent front side plan view of the light-housing component of the nail curing bowl.
Figure 6B:
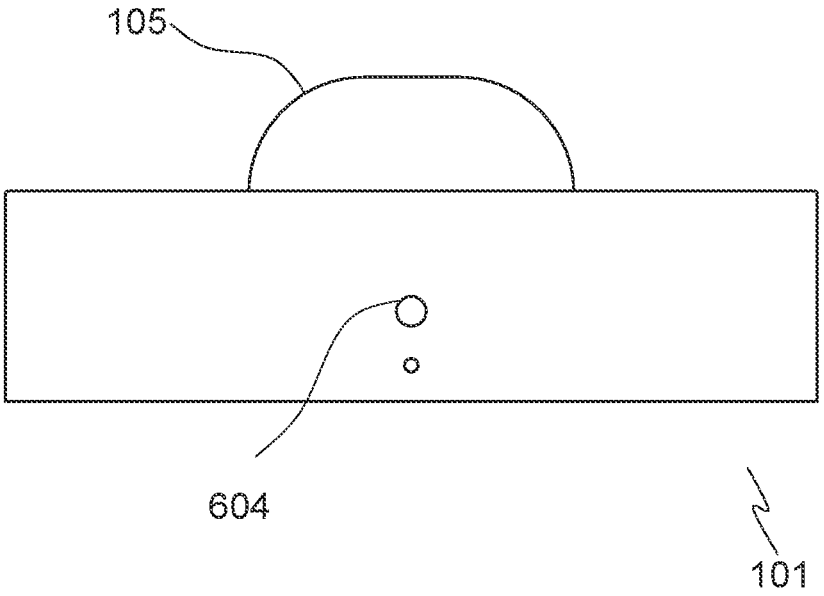
FIG. 6B illustrates a front side plan view of the light-housing component of the nail curing bowl.
Figure 7:
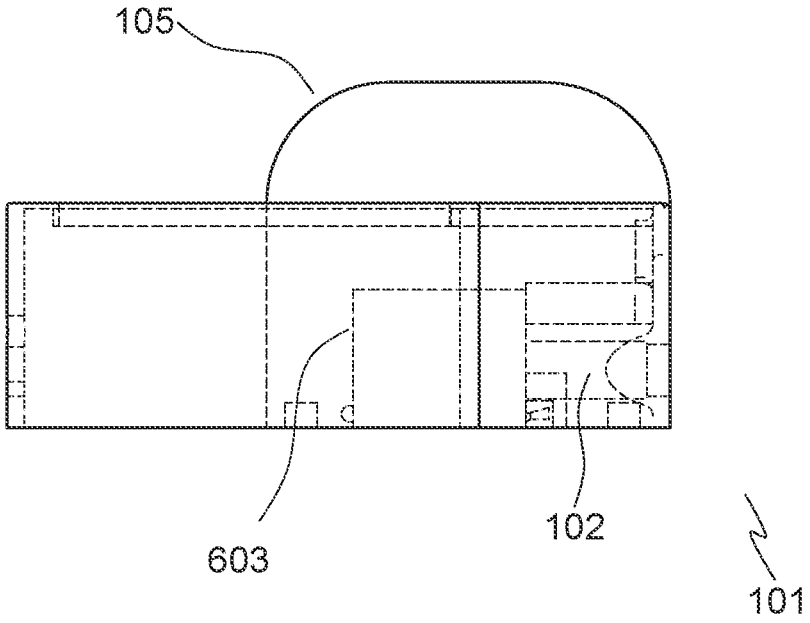
FIG. 7 illustrates a partially-transparent side plan view of the light-housing component of the nail curing bowl.

The light-housing component 101 further comprises a control unit 603 that includes a power cord socket 102 for a power cord to extend from the bottom portion of hand rest 105 through the outer surface of the light-housing component 101, as illustrated in FIG. 6A. In an alternative embodiment, the control unit 603 includes a battery component for housing batteries as a power source instead, or in addition to, the power cord. In one embodiment, the light-housing component 101 also comprises an operating switch 604, as illustrated in FIG. 6B. The operating switch is positioned on the outer surface of the light-housing component 101. As illustrated in FIGS. 6A, 6B, and 7, in one embodiment, the power cord socket 102 exists at the bottom of the second side of the light-housing component 101 opposite of the operating switch 604. Inputs from the operating switch are provided to the control unit 603 situated in the hand rest 105, which controls the supply of electrical current to the UV lights within the inner surface of the light-housing component 101. In one embodiment, the control unit supplies an electrical current to the UV lights when a trigger is activated. The trigger may be activated when a trigger event occurs, such as when a hand is detected resting on the hand rest 105 or when fingers or fingernails are detected within the inner area of the light-housing component 101. Cessation of the trigger event may cause an auto power shut-off of the control unit 603. In another embodiment, the control unit includes an auto power shut-off timer that will activate when the set duration of time elapses.

Figure 8:
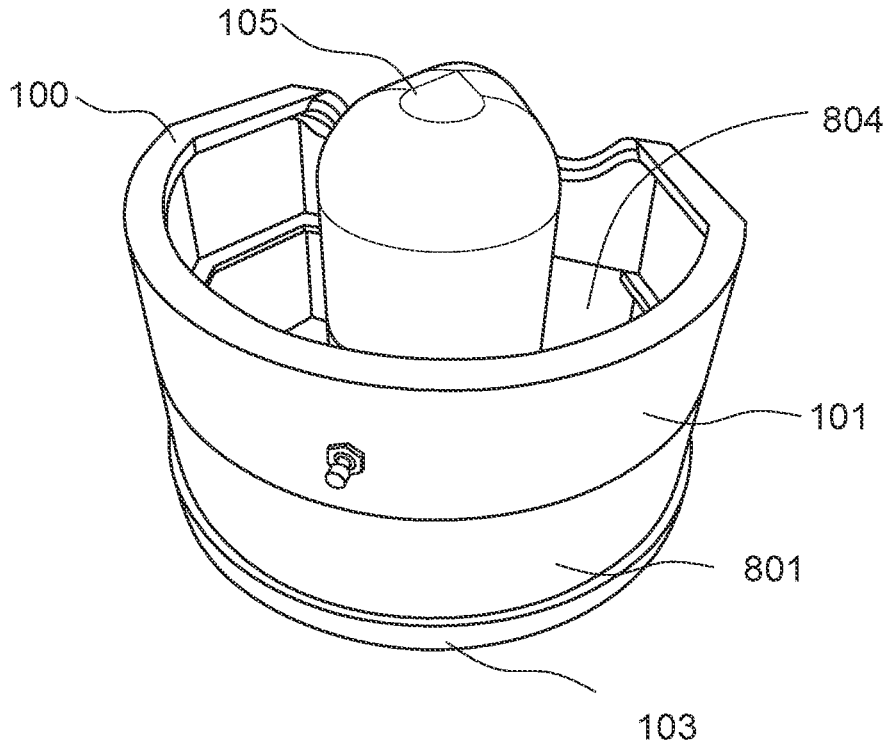
FIG. 8 illustrates an isometric and side perspective view of an extended nail curing bowl.
Figure 9:
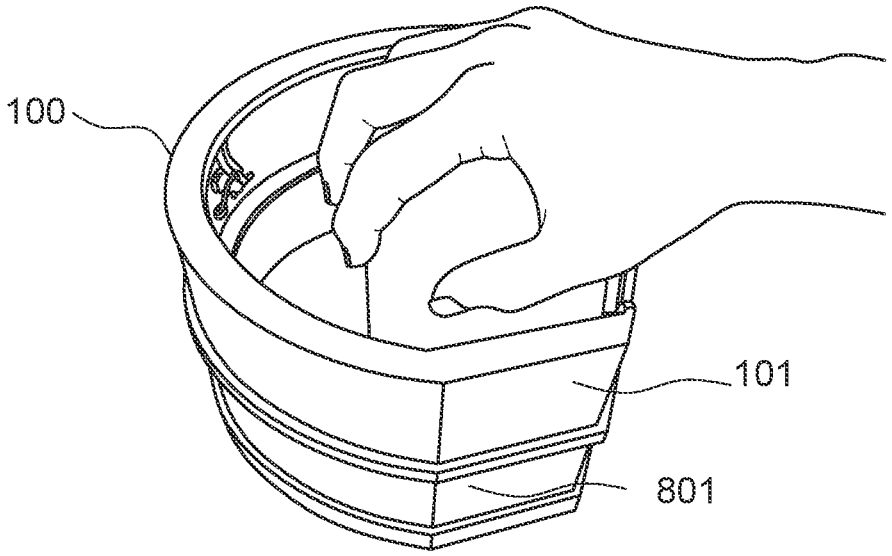
FIG. 9 illustrates a hand of a user using the extended nail curing bowl.

The height of the nail curing bowl may be manually adjusted based on the length of the nails of the user. As illustrated in FIG. 8, an extension component 801 can be nested between the removable base plate 103 and the light-housing component 101. The nail curing bowl 100, when extended using the extension component 801, creates a deeper well 804 to accommodate users with longer fingernails, as illustrated in FIG. 9.

Figure 10:
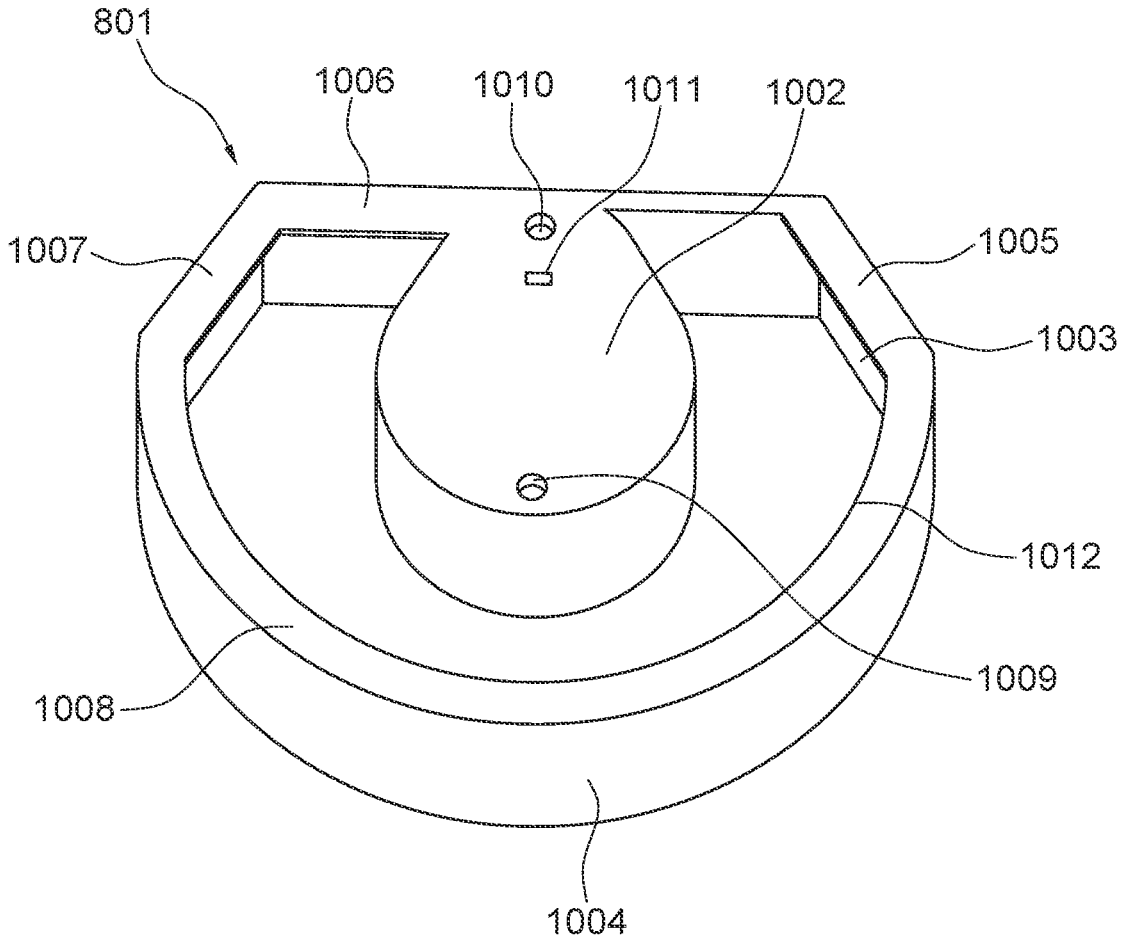
FIG. 10 illustrates a top perspective view of the extension component of the nail curing bowl.

FIG. 10 illustrates a top view of the extension component 801. The extension component 801 comprises a hand rest support 1002 protruding from an inner surface 1003, an outer surface 1004, a first straight side 1005, a second straight side 1006, a third straight side 1007, and a fourth rounded side 1008.

Figure 11:
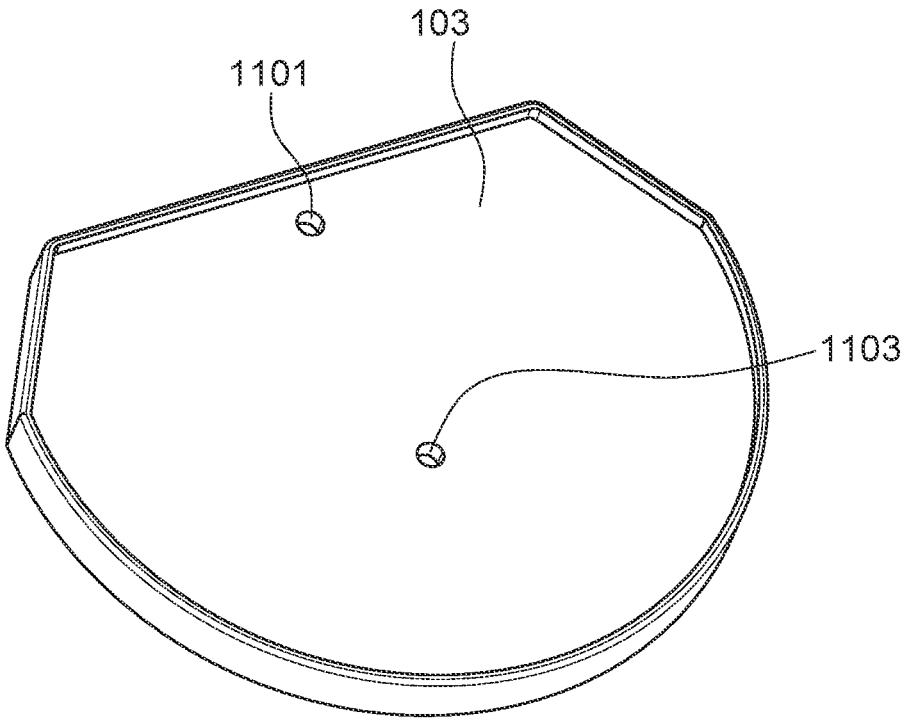
FIG. 11 illustrates a top perspective view of the base plate of the nail curing bowl.
Figure 12:
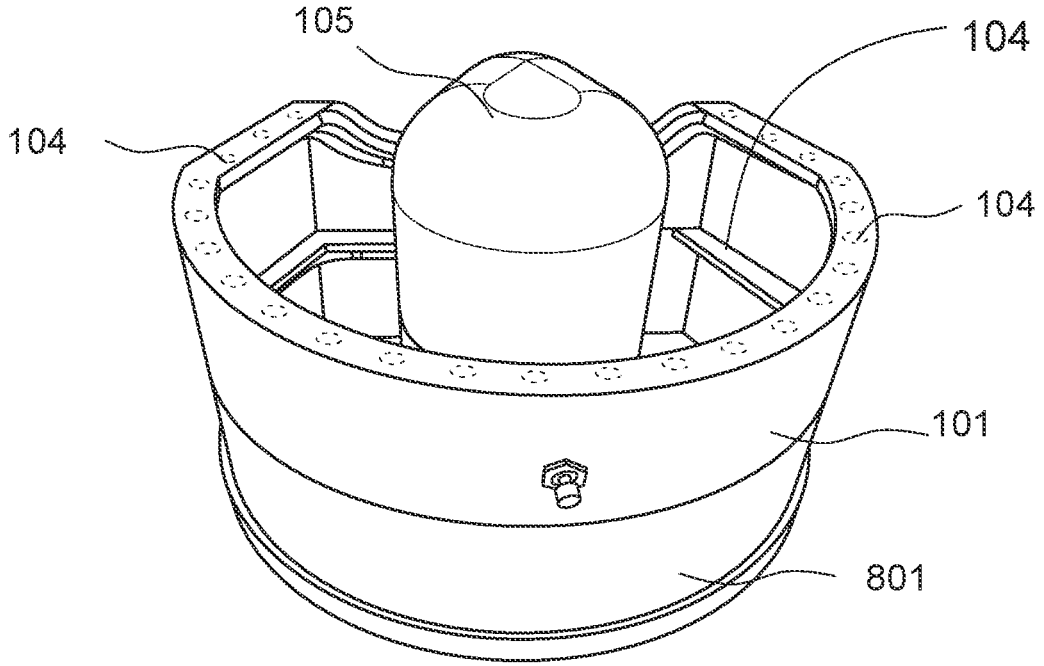
FIG. 12 illustrates a front side perspective view of the extended nail curing bowl.

The top end of the hand rest support 1002 further comprises a power connecter 1011 and two magnets 1009 and 1010. The power connecter 1011 allows electricity to flow from the power module of the light-housing component to the lights mounted to the inner surface 1003 of the extension component 801, as illustrated in FIGS. 11 and 12. The two magnets 1009 and 1010 are used to removably attach to the magnets 402 and 403 situated on the bottom of the hand rest 105 of the light-housing component. The bottom end of the hand rest support 1002 also include two magnets that are used to removably attach the extension component 801 to the two magnets located on the base plate 103. FIG. 11 illustrates a base plate 103 comprising two magnets 1101 and 1103.

The lights mounted to the inner surface 1003 of at least one side of the extension component 801 may be any type of light preferred by the manufacturer to cure gel nail polishes, acrylic nails, or the like. In a preferred embodiment, inner surface 1003 comprises a plurality of UV LED lights that emit UVA rays to cure gel nail polishes, acrylic nails, or UV/LED curing products. The UV LED lights are mounted to the wall of at least one of the first straight side 1005, a second straight side 1006, a third straight side 1007, and a fourth rounded side 1008 so as to generate another evenly distributed field of light in the interior of the nail curing bowl. The UV LED lights may be mounted throughout the inner surface 1003 or may be dispersed in only part of the inner surface 1003. For example, the UV LED lights may be mounted to the inner surface 1003 only near the top end of the extension component 801, only near the bottom end of the extension component 801, a combination of near the top end and the bottom end of the extension component 801, or throughout inner surface 1003 of the extension component 801.

Figure 13:
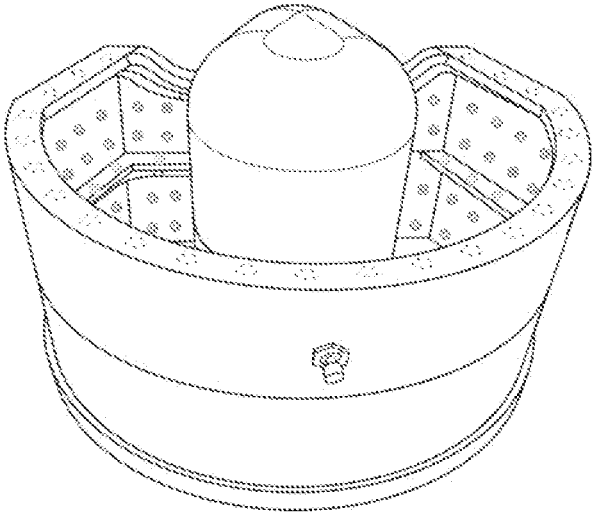
FIG. 13 illustrates a front side perspective view of the extended nail curing bowl.

FIG. 12 illustrates a plurality of UV LED lights 104 mounted to the inner surface of the top end of the light-housing component 101 and the top end of the extension component 801. The number and type of lights will be dependent upon the size and circumference of the walls of the extension component 801 and other factors, such as desired brightness of the distributed field of light within the interior of the nail curing bowl. Although shown as a plurality of lights mounted to the inner surface walls of the extension component, one skilled in the art appreciates that any type of lighting can be mounted to the inner surface walls of the extension component, such as a single tubular UV light. FIG. 13 illustrates a plurality of UV LED lights mounted across all of the inner surface of the light-housing component and the extension component. The number of lights, placement of the lights, and type of lights may vary, and may also be based upon the size and circumference of the walls of the extension component 801 and other factors, such as desired brightness of the distributed field of light within the interior of the nail curing bowl.

In one embodiment, the inner surface 1003 or part of the inner surface 1003 of the extension component 801 may comprise a reflective mirror to provide maximum exposure of the field of light within the nail curing bowl. The reflective mirror may be any type of mirror that reflects UV rays, such as aluminum or "first surface" mirror. The light field, including the UV rays, produced by the lights mounted to the inner surface of the extension component would bounce off the reflective mirror to increase the exposure of the nails of the user to the UV rays. In an alternate embodiment, the inner surface 1003 of the extension component 801 does not comprise any mounted lights but comprises a reflective mirror to reflect the light and UV rays from the light mounted to the inner surface of the light-housing component.

The top end of the extension component 801 comprises a rim 1012. In one embodiment, the rim 1012 may be an inwardly extending rim that protrudes into the body of the extension component 801, as illustrated in FIG. 10. The inwardly extended rim reduces the distribution of the field of light outside of the nail curing bowl to protect the eyes and skin of a user using the nail curing bowl and/or the manicurist. The width and shape of the inward extension of the rim may be increased or decreased.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments disclosed.

What is claimed is:

1. A nail curing bowl comprising:

a base; and a hollow body created by a light-housing component being removably attached to the base, the hollow body having an open top portion to allow at least a portion of fingers of a human hand to be inserted within an inside area of the hollow body, the hollow body including:

an inner surface of the light-housing component housing a plurality of ultra-violet light emitting diodes (UV LEDs), a hand rest located within the hollow body and protruding above a top rim of the light-housing component, wherein the hand rest includes a shaft and a top, a portion of an outer surface of the shaft being attached to the inner surface of the light-housing component; and a control unit providing electrical power to the plurality of UV LEDs causing the UV LEDs to emit UV irradiation throughout the inside area of the hollow body, such that fingernails and a thumbnail of the human hand resting on the hand rest receive equal amounts of UV irradiation sufficient to cure a UV/LED curable product applied to the fingernails and the thumbnail.

2. The nail curing bowl of claim 1, further comprising:

an extension component nested between, and removably attached to, the base and the light-housing component creating a deeper hollow body to allow for longer fingernails and a longer thumbnail of a human hand to fit within an inside area of the deeper hollow body.

3. The nail curing bowl of claim 2, wherein the extension component includes an inner surface housing a plurality of UV LEDs operatively connected to the control unit, the control unit providing electrical power to the plurality of UV LEDs within the extension component causing the UV LEDs to emit UV irradiation throughout the inside area of the deeper hollow body, such that the fingernails and the thumbnail of the human hand resting on the hand rest receive equal amounts of UV irradiation sufficient to cure the UV/LED curable product applied to the fingernails and thumbnail.

4. The nail curing bowl of claim 1, wherein the control unit provides the electrical power to the plurality of UV LEDs in response to a trigger event.

5. The nail curing bowl of claim 4, wherein the trigger event includes receiving input from an operating switch.

6. The nail curing bowl of claim 4, wherein the trigger event includes at least one of: detection of the human hand resting on the hand rest, detection of the fingernails or the thumbnail within the inner space of the hollow enclosure, and detection of fingers or thumbs along a shaft portion of the hand rest.

7. The nail curing bowl of claim 4, wherein the control unit includes a timer for an automatic shut off of the electrical power provided to the UV LEDs after a predetermined time period, the timer initializing the predetermined time period in response to the trigger event.

8. The nail curing bowl of claim 1, wherein the top rim of the light-housing component includes an inward facing lip to reduce the distribution of the UV irradiation outside of the hollow body.

9. The nail curing bowl of claim 1, wherein the shaft has a greater circumference than the top of the hand rest.

10. The nail curing bowl of claim 1, wherein the base is removably attached to the light-housing component by at least one magnet.

11. The nail curing bowl of claim 1, wherein the control unit includes a battery component for housing at least one battery as a power source for the electrical power.

12. The nail curing bowl of claim 1, wherein the electrical power is provided to the control unit through an electrical wall socket.

13. The nail curing bowl of claim 1, wherein the inner surface of the light-housing component comprises a reflective mirror to provide maximum exposure of the UV irradiation within the hollow body.

14. The nail curing bowl of claim 13, wherein the reflective mirror is made of at least one of an aluminum and a "first surface" mirror.

15. The nail curing bowl of claim 1, further comprising:

an extension component nested between and attached to the base and the light-housing component creating a deeper hollow body, an inner surface of extension component comprising only a reflective mirror to reflect the UV irradiation from the UV LEDs mounted to the inner surface of the light-housing component.

* * * * *